US007367077B2

(12) United States Patent
Rutkowski et al.

(10) Patent No.: US 7,367,077 B2
(45) Date of Patent: May 6, 2008

(54) DRAIN CLEANING APPARATUS

(75) Inventors: Michael J. Rutkowski, Brunswick, OH (US); Larry F. Babb, Grafton, OH (US)

(73) Assignee: Emerson Electric Co., St. Louis, MO (US)

( * ) Notice: Subject to any disclaimer, the term of this patent is extended or adjusted under 35 U.S.C. 154(b) by 424 days.

(21) Appl. No.: 10/793,446

(22) Filed: Mar. 4, 2004

(65) Prior Publication Data

US 2005/0193509 A1 Sep. 8, 2005

(51) Int. Cl.
*B08B 9/02* (2006.01)

(52) U.S. Cl. ..... 15/104.33; 15/104.31; 15/104.32

(58) Field of Classification Search ..... 15/104.33, 15/104.31, 104.32; 226/35, 154, 155; 242/390
See application file for complete search history.

(56) References Cited

U.S. PATENT DOCUMENTS 1,532,177 A * 4/1925 Gist ..... 248/89
2,450,486 A 10/1948 Perry
2,460,149 A 1/1949 Shoensiegel
2,625,699 A 1/1953 Jurasevich
3,317,943 A 5/1967 Primm
3,574,878 A * 4/1971 Shames et al. ..... 15/104.33
3,897,602 A * 8/1975 Waterbury ..... 15/104.33
4,570,281 A * 2/1986 Boelens ..... 15/104.33
6,009,588 A 1/2000 Rutkowski
6,158,076 A 12/2000 Rutkowski et al.
6,412,136 B1 * 7/2002 Rutkowski ..... 15/104.33
6,615,436 B1 9/2003 Burch et al.

* cited by examiner

*Primary Examiner*—Shay L Karls
(74) *Attorney, Agent, or Firm*—Rankin, Hill & Clark LLP

(57) ABSTRACT

Drain cleaning apparatus comprises a housing in which a drain cleaning cable is coiled and from which the cable is displaced for introducing an outer end of the cable into a drain to be cleaned. The housing is stationary and the cable is rotated about its axis relative to the housing by a drive motor coupled to an inner end of the cable. A manually operable cable feeding device can be coupled with the housing for feeding the cable outwardly and inwardly relative to the housing.

53 Claims, 12 Drawing Sheets

DRAIN CLEANING APPARATUS

BACKGROUND OF THE INVENTION

This invention relates to drain cleaning apparatus and devices and, more particularly, to improvements in portable, motor-operated drain cleaners.

Relatively small, portable drain cleaners are of course well known and, generally, include a drain cleaning snake or cable coiled in a housing or drum from which an end of the cable extends for introduction into a drain or sewer line to be cleaned. The drum is rotated in order to rotate the cable about its axis as the latter is advanced into the drain, and such rotation of the drum is achieved by coupling the drum with a suitable drive motor which, in some instances is provided by a hand held drill. The cable is advanced out of the drum and into a drain either manually, by pulling the cable outwardly of the drum, or through the use of a cable feeding device attached to the drum as shown, for example, in U.S. Pat. No. 6,158,076 to Rutkowski, et al. and U.S. Pat. No. 6,615,436 to Burch, et al., or to a guide tube or hose as shown, for example, in U.S. Pat. No. 6,009,588 to Rutkowski, all of which patents are incorporated herein by reference for background information.

In such drain cleaning apparatus heretofore known, the drum is a rotating part which a user must contend with during operation of the drain cleaner. Moreover, in the absence of a cable feeding device, the user must de-energize the drive motor and manually displace the cable out of the drum during a drain cleaning operation and back into the drum following completion of the operation. Such manual displacement of the cable exposes the user's hands, gloves or other clothing to the grime and other moisture-laden material which adheres to the cable as the latter advances into and is withdrawn from a drain or the like being cleaned. In any event, the drain cleaning apparatus and devices of the foregoing character heretofore available are not easy to use, most often do not provide for hands-off operation with respect to the cable, expose a user to contact with the rotating cable drum, and render a drain cleaning operation tedious and, often, undesirably time-consuming.

SUMMARY OF THE INVENTION

In accordance with the present invention, motor-operated drain cleaning apparatus is provided by which the foregoing and other disadvantages of such devices heretofore available are advantageously minimized or overcome. More particularly in this respect, a drain cleaning device in accordance with the invention provides for the drain cleaning cable to be stored in a non-rotating housing and to be rotated about the cable axis when the cable is in a drain by a motor coupled to the end of the cable in the housing. Advantageously, the outer or operating end of the cable can be associated with a cable feeding device coupled to the housing, such as through the use of a flexible guide tube or hose, whereby an operator of the apparatus does not have to come into contact with rotating parts of the apparatus, or the cable which rotates relative thereto and is advanced and retracted relative to the housing by the feeding device. Accordingly, use and operation of the device with a cable feeding mechanism is much easier than is the operation of units heretofore available and, moreover, affords the operator the ability to avoid contact with the cable and thus exposure to dirt, grime and other undesirable matter which may accumulate on the cable during a drain cleaning operation. Still further, a user is much more relaxed in connection with using the apparatus in that he or she does not see any rotating parts of the apparatus other than the cable, and visibility of the latter is minimal once the operating end of the cable is in a drain, especially if displacement of the cable into and from the drain is through the use of a cable feeding mechanism. Suitable cable feeding devices can include those shown in the aforementioned patents and, preferably, is one enabling displacement of the cable out of and into the housing without changing the direction of the drive motor, such as the feed mechanisms disclosed in co-pending application Ser. Nos. 11/179,957 and 10/792,983 in the name of Rutkowski, et al. and which is assigned to the same assignee as the present application.

It is accordingly an outstanding object of the present invention to provide improved, motor-operated drain cleaning apparatus.

Another object is the provision of apparatus of the foregoing character in which rotation of the drain cleaning cable about its axis during displacement relative to a drain being cleaned is achieved by rotating the cable by a motor coupled to the end of the cable in a housing of the device.

Yet another object is the provision of apparatus of the foregoing character in which the drain cleaning cable is stored in a non-rotating housing and is directly rotated about the cable axis relative to the housing.

A further object is the provision of drain cleaning apparatus of the foregoing character which is portable, easy to use, does not have any visible rotating parts, such as a cable drum, and affords an opportunity for hands-off use or use with a minimum hand contact with the cable during a drain cleaning operation.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
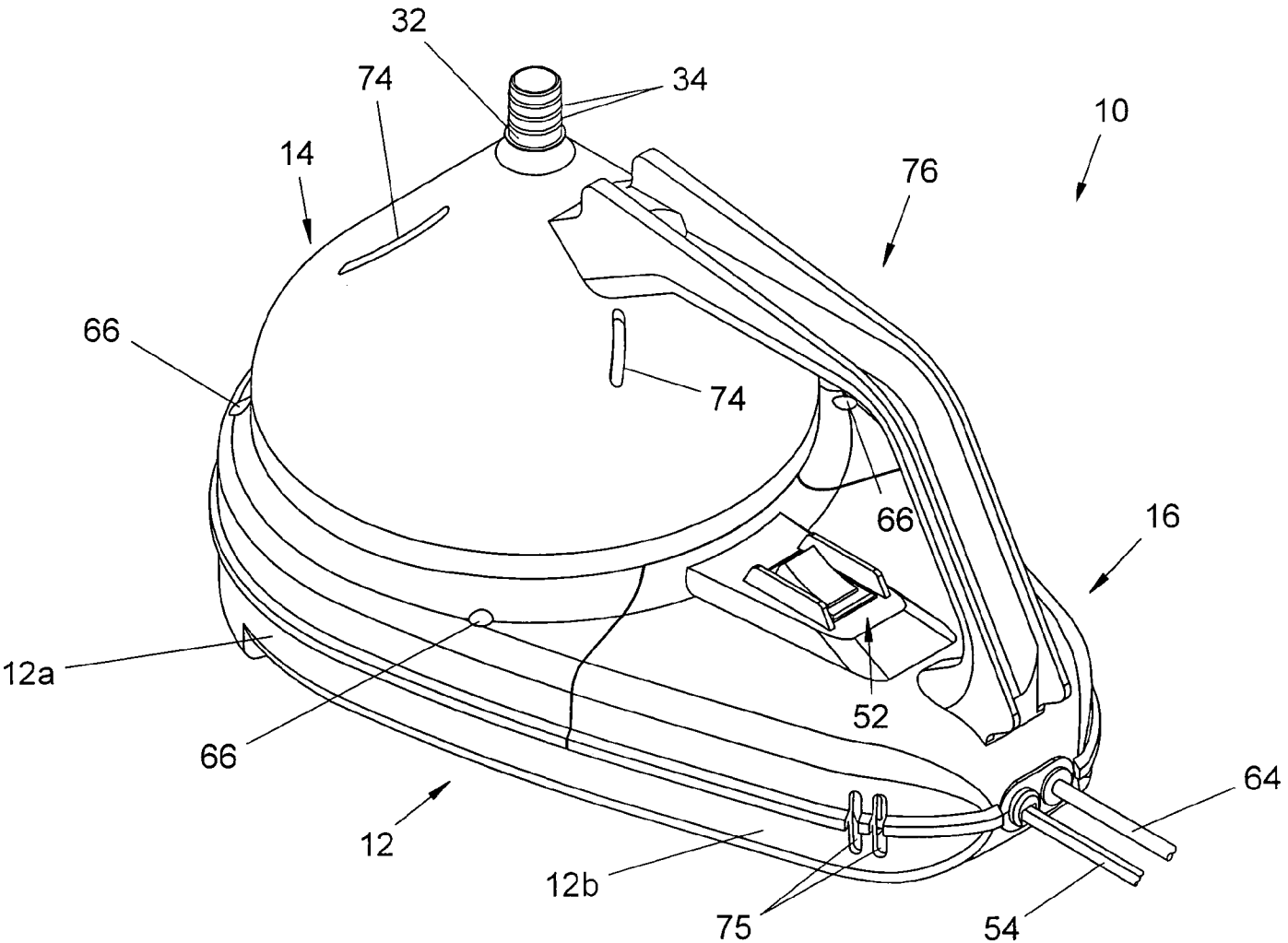
FIG. 1 is a perspective view of drain cleaning apparatus in accordance with the invention.

Referring now in greater detail to the drawings, wherein the showings are for the purpose of illustrating preferred embodiments of the invention only and not for limiting the invention, drain cleaning apparatus 10 illustrated in FIGS. 1-4 includes a housing comprising a base 12 and a cover which, in this embodiment, includes first and second cover portions 14 and 16, respectively, which overlie and are attached to base 12 as set forth more fully hereinafter. Base 12 has a first portion 12*a* which includes an annular wall 18 extending upwardly of the base and having a vertical axis A, and a domed wall 20 extending upwardly and radially inwardly from annular wall 18 and having a closed upper end or apex 22. Base 12 further includes a second base portion 12*b* integral with and extending laterally of the first base portion and having an upwardly open compartment area 24 providing a lower portion of a motor and switch compartment as set forth more fully hereinafter. Cover portion 14 forms an outer shell of the housing with respect to base portion 12*a* and includes an annular wall 26 radially outwardly of and surrounding annular wall 18 of the base and a domed wall 28 extending upwardly and inwardly of wall 26 so as to be radially spaced from and overlie domed wall 20 of the base. Domed wall 28 terminates at its upper end in a cable opening 30 coaxial with axis A and, preferably, wall 28 includes a sleeve portion 32 having an outer surface provided with ribs or barbs 34 for frictionally interengaging with and coupling a flexible guide hose 36 with the cover.

The spaced annular and domed walls provide a cable passageway 38 having a lower end 38*a* and an upper end 38*b* which communicates with cable opening 30, and a drain cleaning cable 40 is coiled in the lower portion of passageway 38 about annular wall 18 of base 12. Cable 40 has an inner end 42 relative to the housing which extends tangentially from lower end 38*a* of passageway 38 through an opening 44 in the lower portion of annular wall 26 of the cover for coupling with a drive motor unit M of the apparatus as set forth more fully hereinafter. Cable 40 extends upwardly from the coil in the lower portion of passageway 38, through cable opening 30 and, in the embodiment shown, through flexible guide tube 36 and a cable feeding device CF which corresponds structurally to a feeding device disclosed in the aforementioned co-pending application Ser. Nos. 11/179,957 and 10/792,983. Basically in this respect, the cable feeder comprises a base B having axially opposite ends and an actuator defined by first and second actuator members A1 and A2, respectively, overlying base B between the opposite ends thereof. Actuators A1 and A2 are mounted on base B by a pivot pin P for displacement toward and away from base B independent of one another, and one of the opposite ends of base B is adapted to receive and frictionally interengage with the outer end of guide tube 36. The feeding device further includes axially spaced apart sets of actuating rolls, each of which sets includes a pair of rolls mounted on the corresponding one of the actuators A1 and A2 and a single roll mounted on base B and underlying the rolls on the corresponding actuator. The rolls of each set are skewed so as to alternately engage with and displace the cable in opposite directions relative to the cable feeder in response to rotation of the cable about its axis. As mentioned, cable 40 extends through the cable feeding device, and the cable has an outer end 46 provided, for example, with a bulb auger BA. Preferably, passageway 38 has a radial dimension which precludes two turns of the coil being in the same radial plane in the passageway. This relationship can be obtained by providing for the radial width of the passageway to be less than twice the outer diameter of the cable.

Second cover portion 16 is contoured to overlie and matingly interengage with second base portion 12*b*, and the interior compartment area 24 of base portion 12*b* and the interior compartment area 48 of second cover portion 16 are structured to axially capture motor unit M and a pneumatically actuated switch unit 50 therebetween. Further, an on-off switch 52 is mounted on cover portion 16 for selectively connecting and disconnecting motor unit M to a power source which, in the embodiment disclosed, is a 110 volt source to which the motor unit is connected by a power cord 54. Motor unit M is mounted on cover portion 16 and comprises an electric motor 56 and a gear box 58 which is driven thereby and which has a slip clutch output coupling 60 for connection to end 42 of cable 40 by means of a pair of set screws 62. Pneumatically actuated switch 50 is mounted on cover portion 16 and is connected to an air hose 64 which, in a well-known manner, has a foot or hand actuator component attached to the outer end thereof and by which pulses of air under pressure are delivered to the switch by depressing the actuator to alternately open and close the switch. While not shown, it will be appreciated that switches 50 and 52 are connected in series with motor M and the power source, whereby displacement of switch 52 to the "on" position connects motor M to the power source subject to the operating condition of switch 50. During use, the operator displaces the actuator of the pneumatically actuated switch to alternately energize and de-energize motor 56 and, accordingly, alternately rotate and stop rotation of cable 40.

Cover portion 14 is removably attached to base 12 by means of a plurality of threaded fasteners, not shown, extending through openings 66 in cover portion 14 and into openings 68 therefor in base 12, and cover portion 16 is removably mounted on the base by a plurality of threaded fasteners, not shown, which extend upwardly from the bottom of base 12 through openings 70 therefor and to openings 72 in cover portion 16. Domed wall 28 of cover portion 14 is provided with a plurality of arcuate slots 74 therethrough which enable observing the movement of cable 40 upwardly toward opening 30 during operation of the apparatus, and housing and cover portions 12*b* and 16 are provided with aligned slots 75 which provide vent openings to the motor unit when the base and cover are assembled. A handle 76 is provided for lifting and transporting the drain cleaner and includes a first end 76*a* attached to domed wall 28 of cover 14 by a threaded fastener 78 extending into the handle from the interior side of wall 28. Second end 76*b* of the handle is releasably interengaged with cover portion 16 by a slot and finger arrangement including slots 80 and 82 in cover portion 16 and fingers 84 and 86 on end 76*b* of the handle which extend through slots 80 and 82, respectively. Finger 84 engages under the inner side of cover portion 16, and the handle is removable with cover portion 14 by removing the fasteners from the openings 66 of the latter and pivoting cover portion 14 and handle 76 clockwise from the position shown in FIG. 2 to disengage fingers 82 and 84 from the corresponding slots and then lifting cover portion 14 and handle 76 from cover portion 16.

Figure 2:
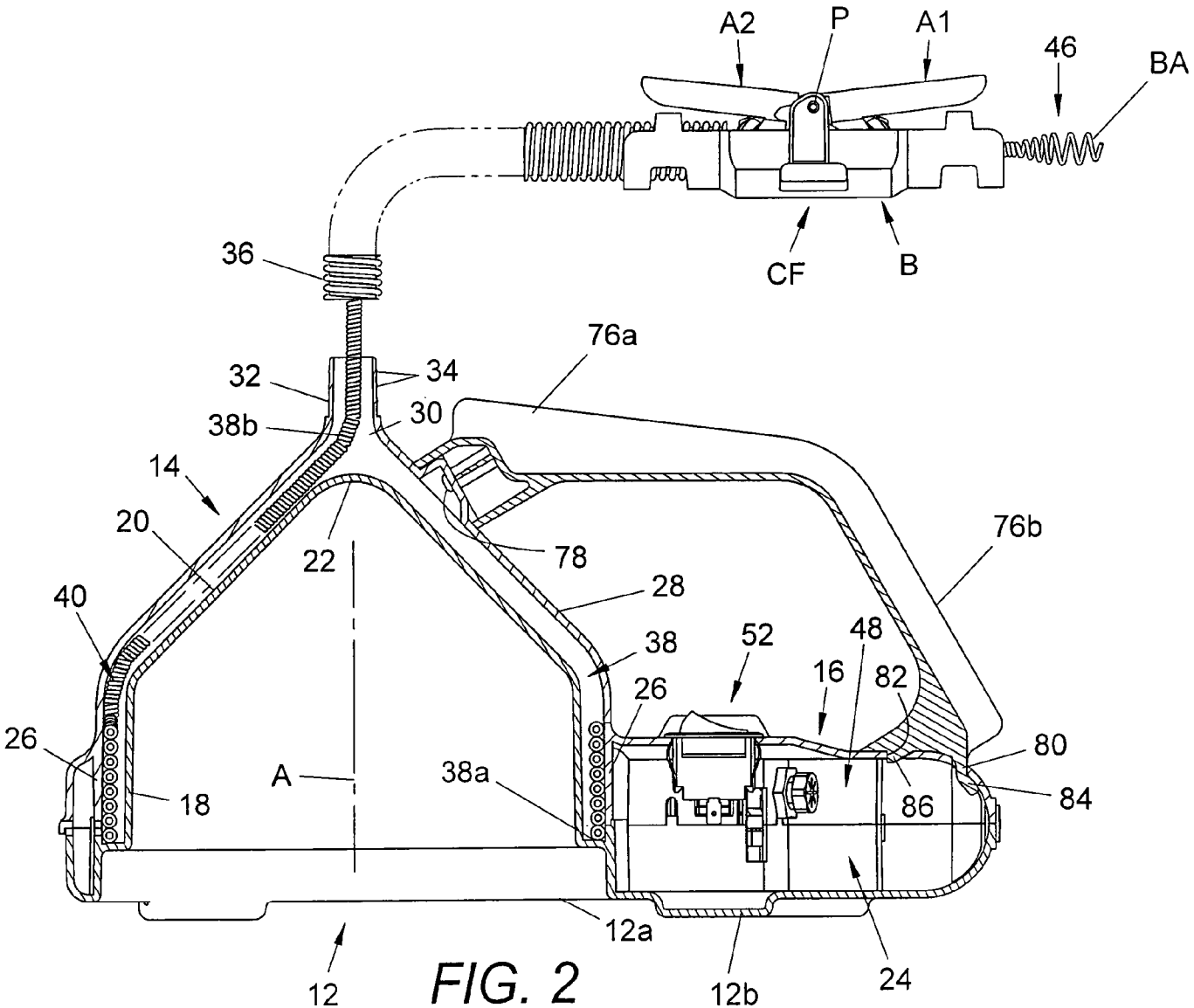
FIG. 2 is a sectional elevation view of the apparatus shown in FIG. 1.
Figure 3:
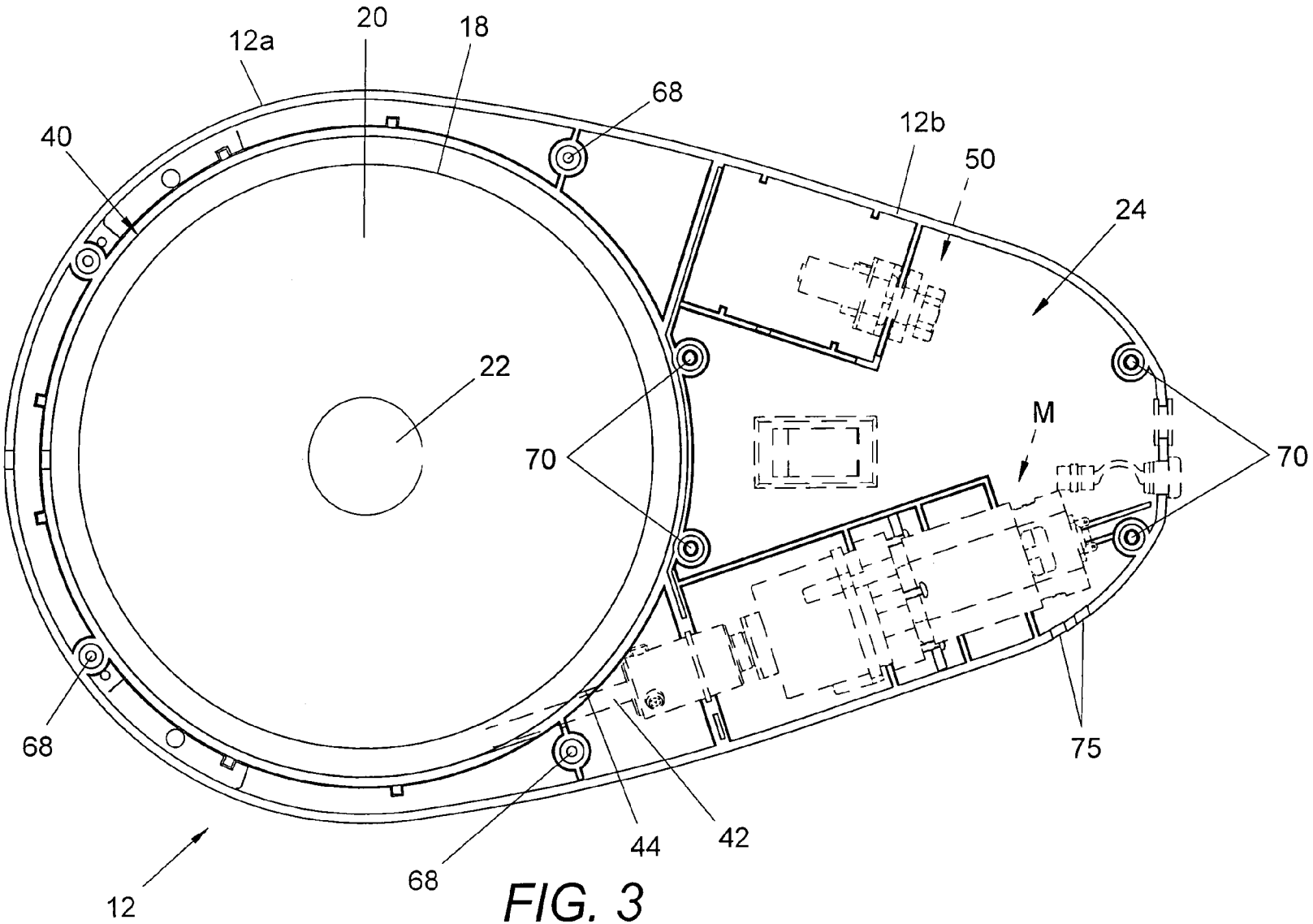
FIG. 3 is a plan view of the base portion of the housing of the apparatus.
Figure 4:
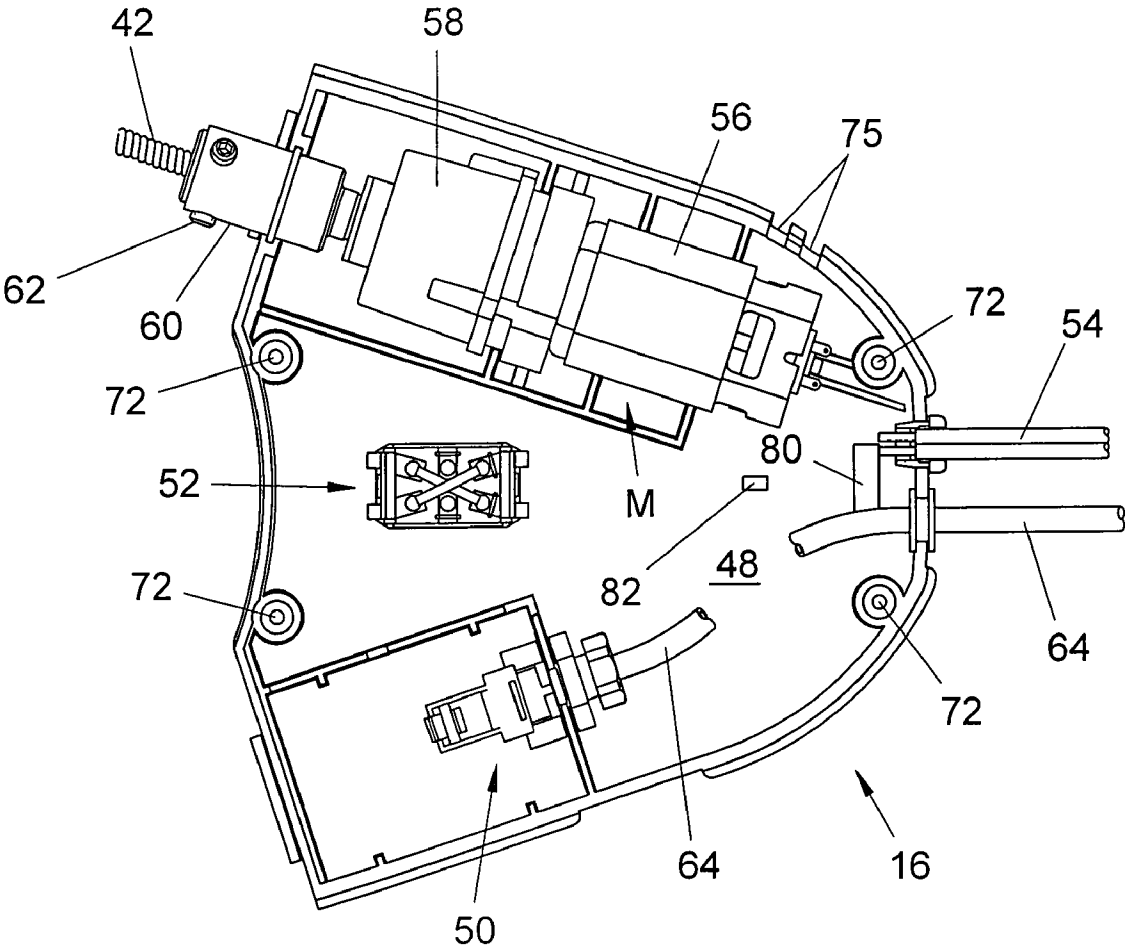
FIG. 4 is an inverted plan view of a cover portion of the housing.

In use, it will be appreciated that power cord 54 is plugged into a power source and switch 52 is then turned to the "on" position to enable energizing of the motor dependent on the condition of pneumatically actuated switch 50. Presuming the operator to depress the actuator of switch 50 to close the switch, motor 56 is energized and cable 40 is rotated relative to base 12 and the cover components. Further presuming the cable feeding device CF to be in a neutral position as shown in FIG. 2, end 46 of the cable rotates relative thereto and can be positioned at the entrance of a drain into which the cable is to be advanced. Assuming actuator A1 to be operable to displace the cable to the right in FIG. 2 relative to the cable feeder, the operator can then displace actuator A1 toward body B of the cable feeding device to engage the cable between the rolls of the corresponding roll set and thus advance the cable into the drain. Selectively, the operator can displace the cable feeding device to its neutral position whereby the cable continues to rotate without being further advanced into the drain. Also, selectively, the operator can actuate switch 50 to open the circuit to motor 56 to interrupt rotation of the cable. Further, upon removal of a blockage and assuming the cable to be rotating relative to the cable feeding device, the operator can displace actuator A2 toward base B, whereupon the cable is engaged between the rolls of the corresponding roll set to reverse the direction of displacement of the rotating cable relative thereto to withdraw the cable from the drain. While the use of a pneumatically operated switch of the foregoing character and a manually operable cable feeding device are preferred in connection with operating the apparatus to optimize the operator's ability to control the operation and to provide hands-free operation, it will be appreciated that control of the drive motor can be achieved through just the on-off switch 52 and that the cable can be manually pulled from the housing and pushed into a drain to be cleaned.

Figure 5:
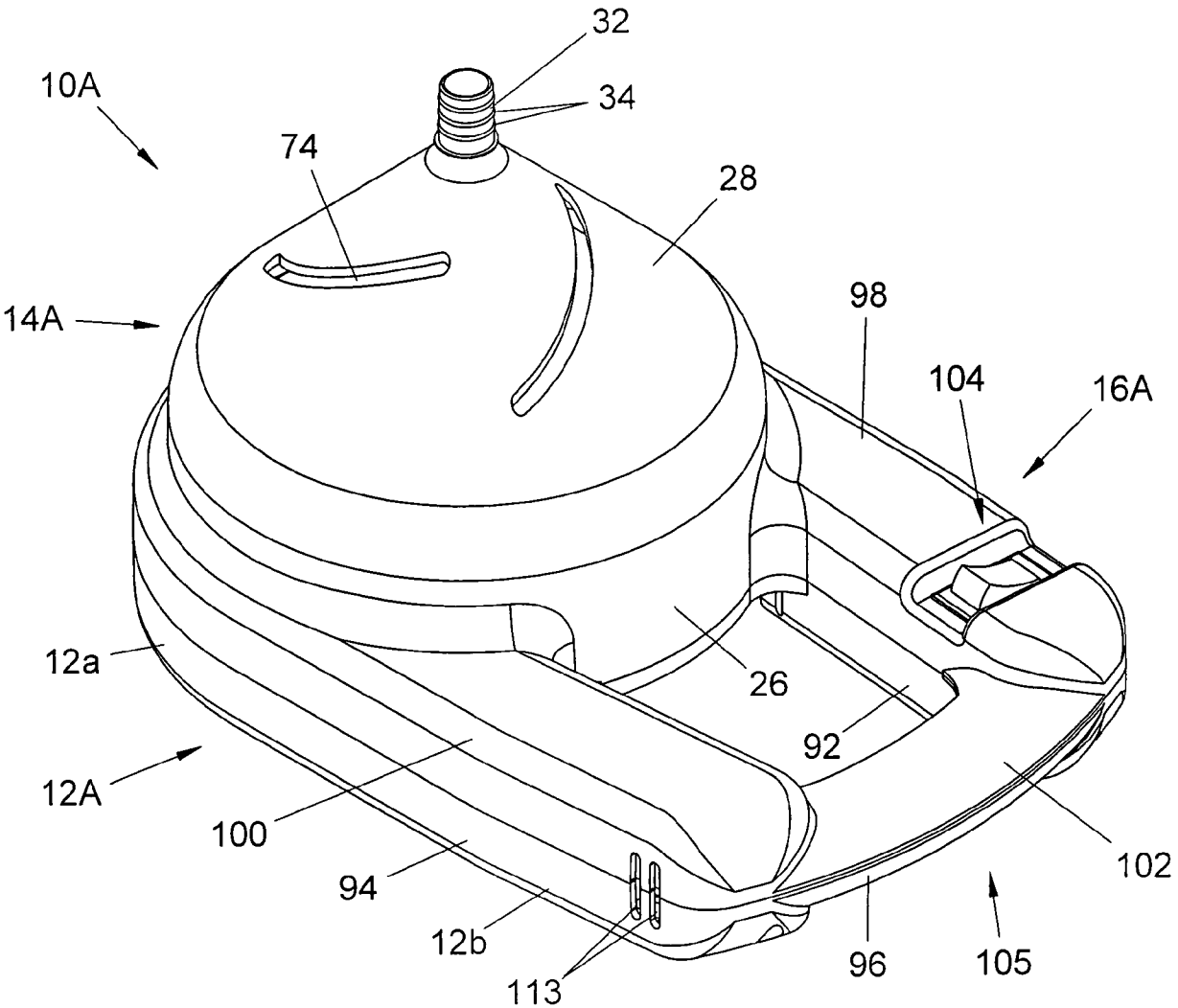
FIG. 5 is a perspective view of another embodiment of drain cleaning apparatus in accordance with the invention.
Figure 6:
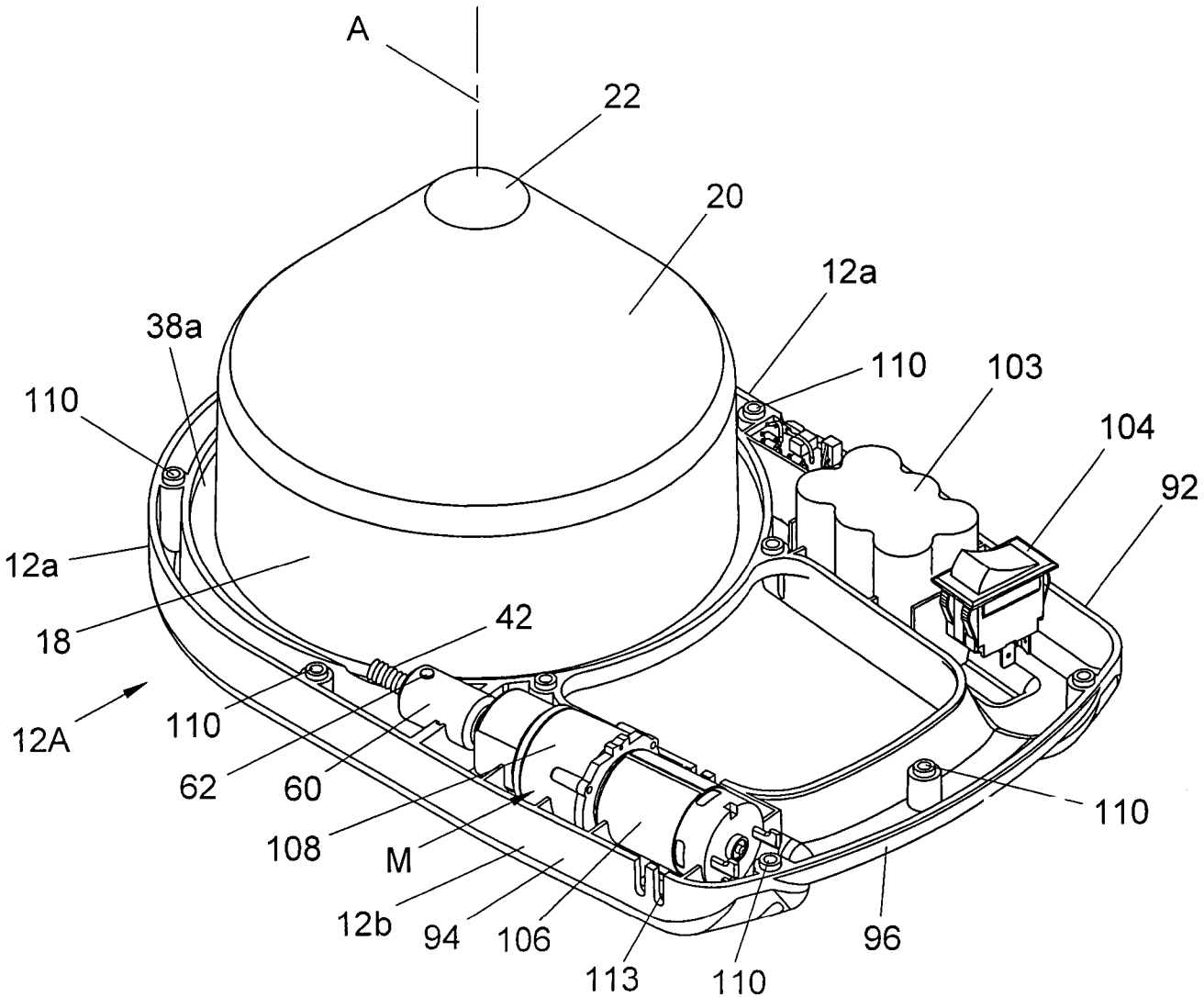
FIG. 6 is a perspective view of the base portion of the housing of the apparatus shown in FIG. 5.
Figure 7:
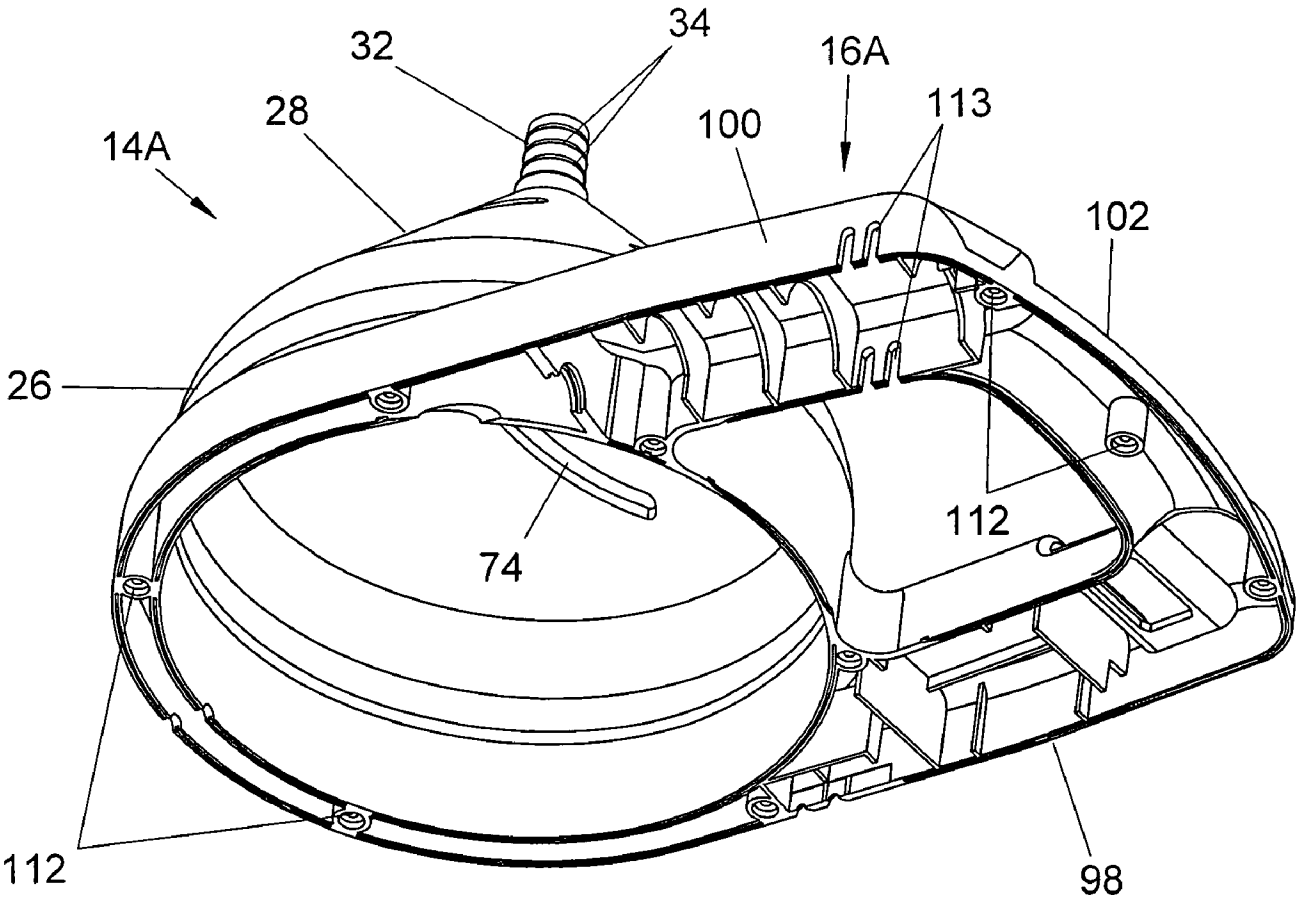
FIG. 7 is an underside perspective view of the cover portion of the housing of the apparatus shown in FIG. 5.
Figure 8:
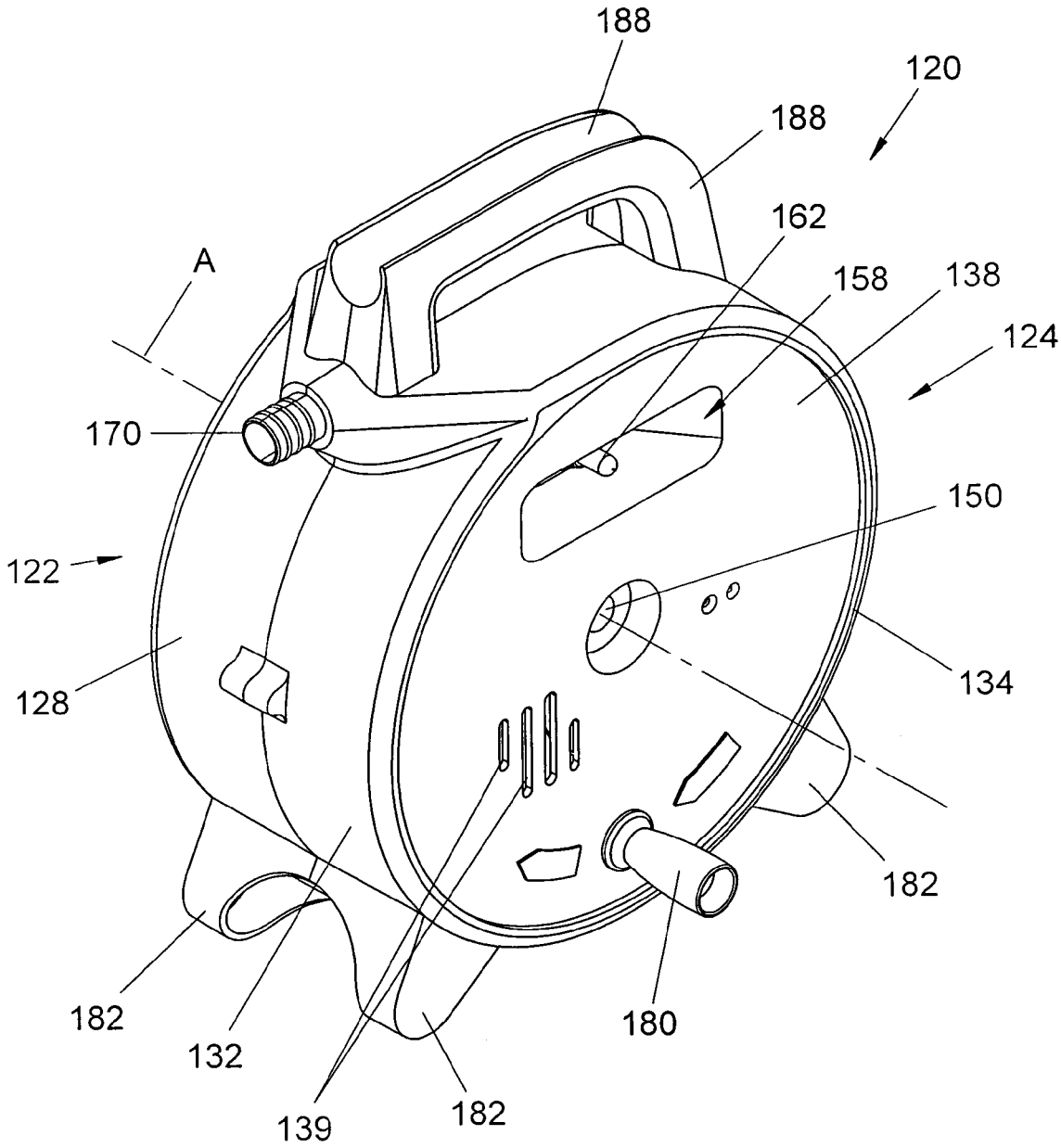
FIG. 8 is a perspective view from one side of yet another embodiment of drain cleaning apparatus in accordance with the invention.
Figure 9:
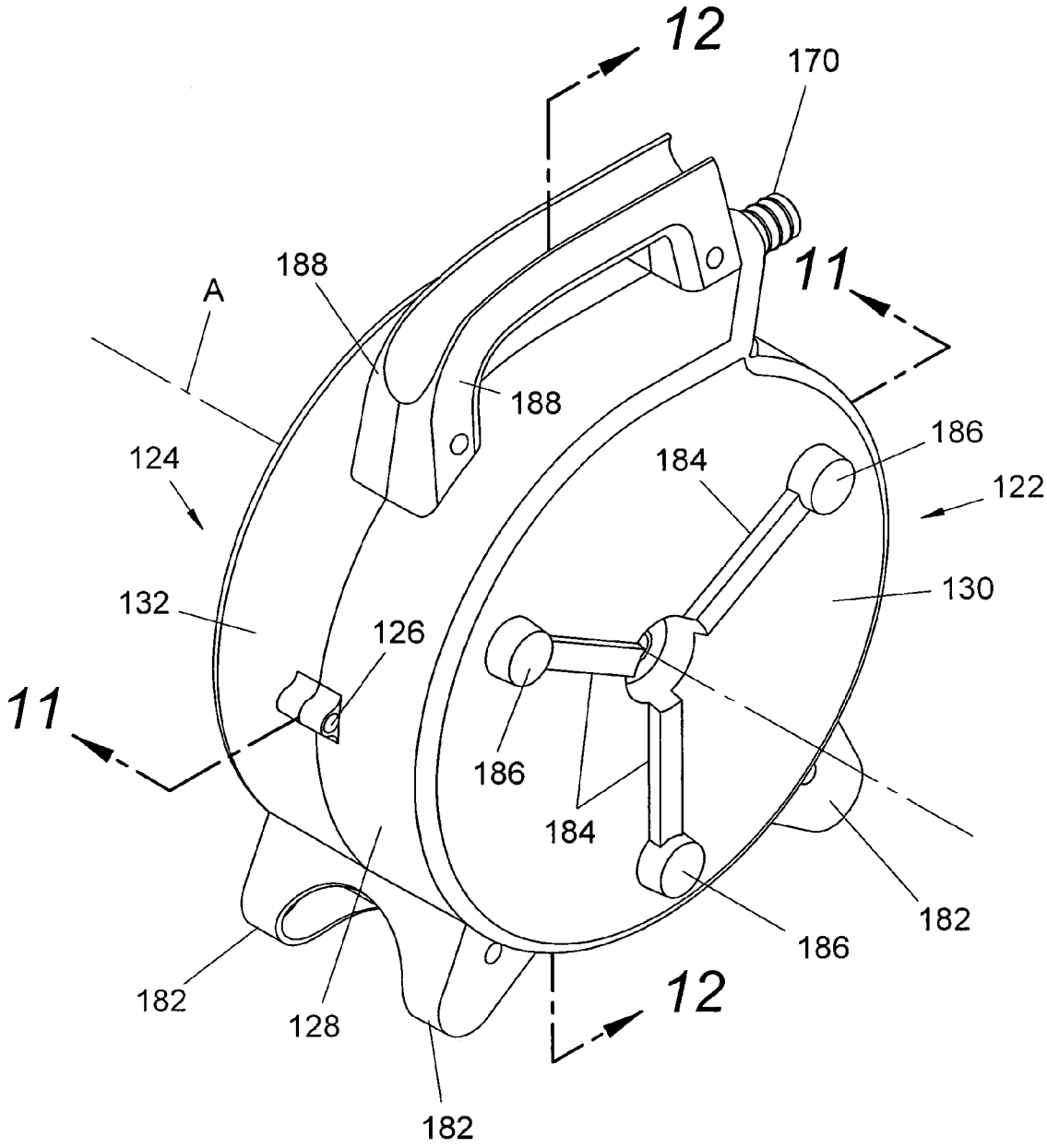
FIG. 9 is a perspective view of the apparatus in FIG. 8 from the opposite side thereof.
Figure 10:
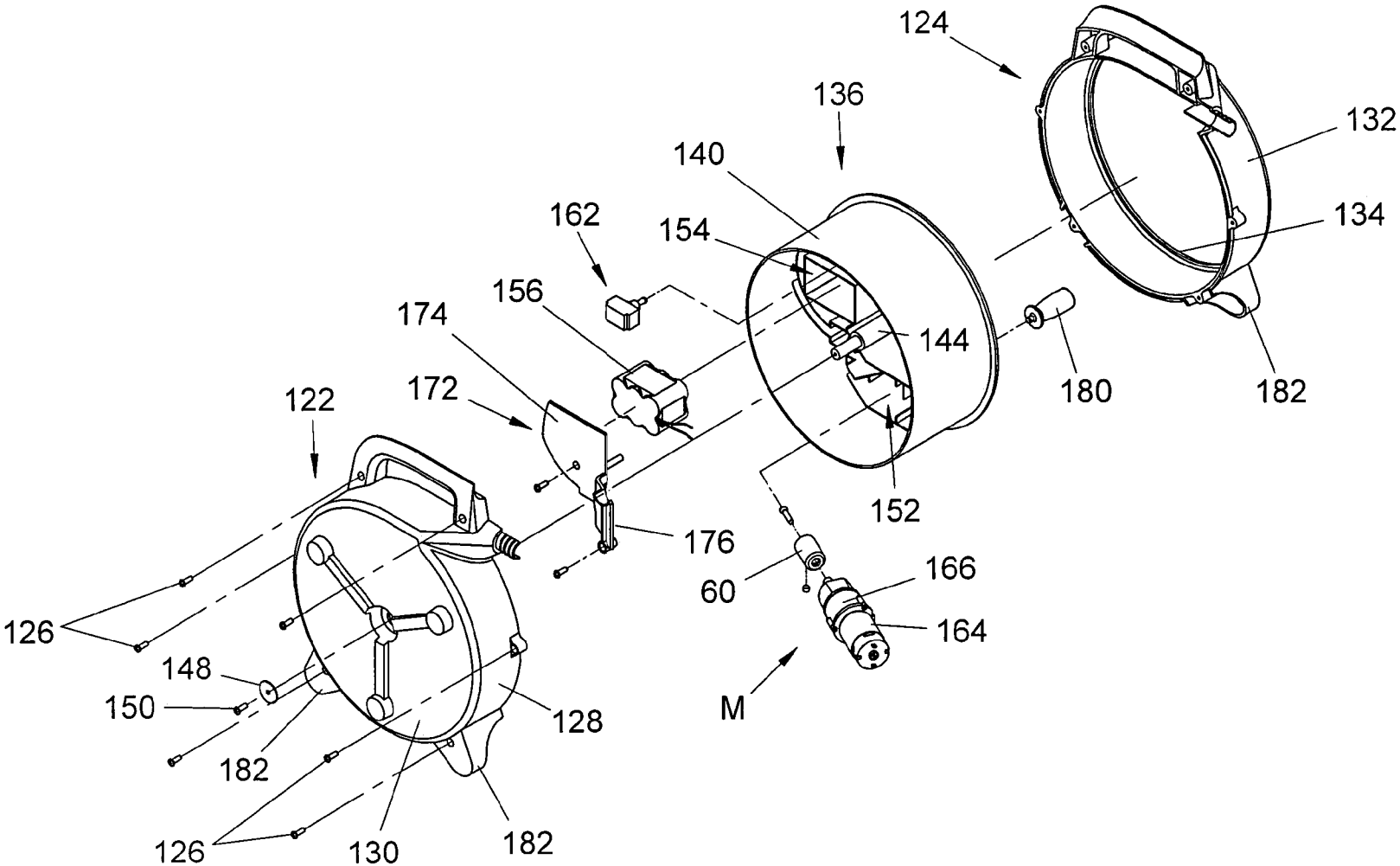
FIG. 10 is an exploded perspective view of the component parts of the apparatus shown in FIGS. 8 and 9.
Figure 11:
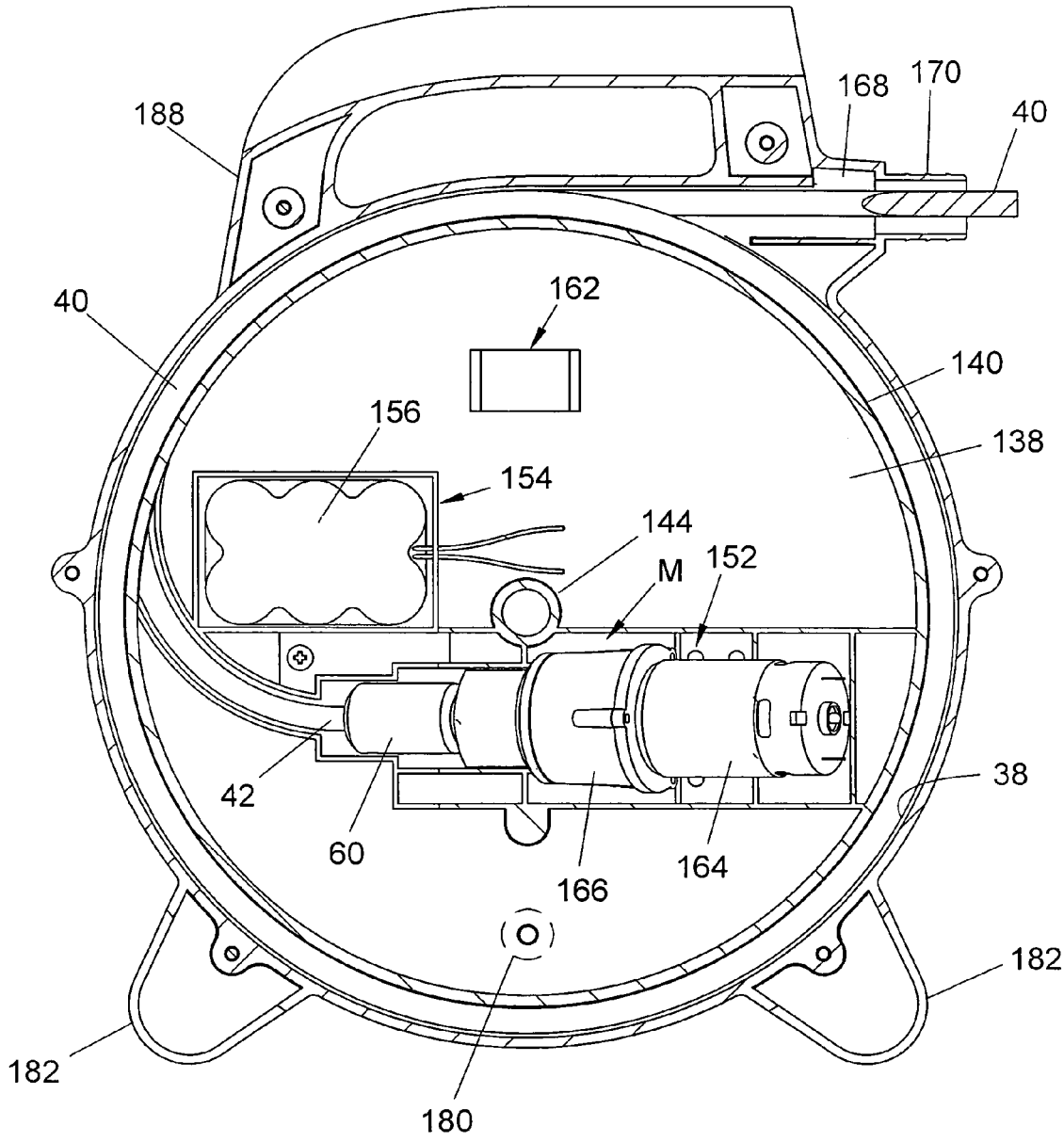
FIG. 11 is a sectional elevation view of the apparatus taken along line 11-11 in FIG. 9; and, FIG. 12 is a cross-sectional elevation view of the apparatus taken along line 12-12 in FIG. 9.
Figure 12:
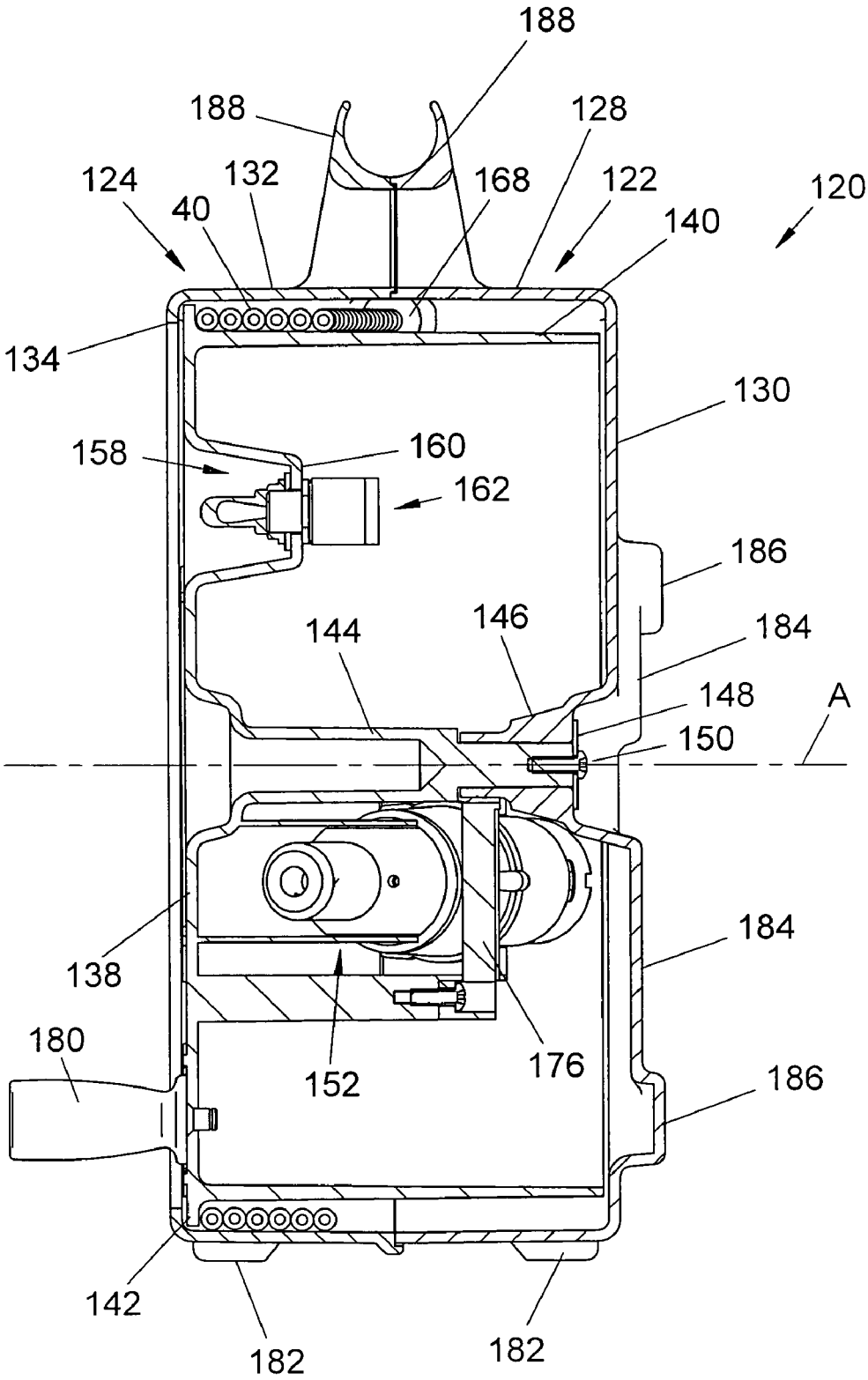

FIGS. 5-7 illustrate drain cleaning apparatus 10A which, primarily, incorporates a modification of the housing structure of apparatus 10 illustrated in FIGS. 1-4. Accordingly, like numerals are used in FIGS. 5-7 to identify component parts corresponding to those of the apparatus in FIGS. 1-4. Drain cleaning apparatus 10A comprises a base 12A which includes a first portion 12*a* comprising annular and domed wall portions 18 and 20, respectively. Base 12A also includes a second U-shaped portion 12*b* integral with and extending laterally from portion 12*a* and defined by legs 92 and 94 extending generally tangentially from the opposite sides of base portion 12*a* and a bridging portion 96 between the outer ends of the legs. As will be appreciated from FIG. 7, the housing of drain cleaning apparatus 10A further includes a cover comprising a first cover portion 14A and a second cover portion 16A which, in this embodiment, is integral with and extends laterally from the first cover portion. Housing portion 14A includes annular and domed wall portions 26 and 28 which are spaced from and overlie and cooperate with wall portions 18 and 20 of the base to provide a cable passageway as shown and described in connection with FIGS. 1-4.

Housing portion 16A is defined by legs 98 and 100 extending generally tangentially of housing portion 14A and a bridging portion 102 between the outer ends of the legs, and when the base and cover portions are assembled, legs 98 and 100 and bridging portion 102 respectively overlie legs 92 and 94 and bridging portion 96 of base portion 12*b*. Moreover, when the base and cover portions are assembled, legs 92 and 98 define a compartment for a battery pack 103 and on-off switch 104, and legs 94 and 100 define a compartment for a motor unit M. Further, as will be appreciated from FIG. 5, the legs and bridging portions of the base and cover members cooperatively provide a carrying handle 105 for the drain cleaning apparatus.

In this embodiment, motor unit M includes a motor 106 and gear box 108 having a slip clutch output coupling 60 for connection to the inner end 42 of a drain cleaning cable. Further, it will be appreciated that the power source for the motor in this embodiment is battery pack 103 and that the latter is connected in circuit with motor 106 through on-off switch 104. As in the embodiment shown in FIGS. 1-4, the drain cleaning apparatus can also be provided with a pneumatically actuated, foot-operated control switch if desired. While not shown, it will be appreciated that the housing portions are interconnected by suitable threaded fasteners extending upwardly through openings 110 therefor in base 12A and into corresponding apertured posts 112 on the cover component. Legs 94 and 100 of the base and cover portion 16A are provided with aligned slots 113 which provide for venting the motor compartment. As will be appreciated from the description herein regarding the embodiment shown in FIGS. 1-4, a drain cleaning cable is coiled about annular wall 18 of the base portion and has an inner end connected to coupling 60 for rotation of the cable about its axis by motor 106, and the cable extends through the cable opening at the top of domed wall 28 of the cover and has an outer end spaced therefrom for introduction into a drain to be cleaned. Furthermore, a cable feeding device such as that described above can be used to displace the cable relative to the housing.

FIGS. 8-12 illustrate yet another embodiment of drain cleaning apparatus in accordance with the present invention. In this embodiment, drain cleaning apparatus 120 includes a cylindrical housing having a horizontal axis A and comprising first and second housing members 122 and 124 axially interconnected by a plurality of threaded fasteners 126. Housing member 122 comprises a circular outer wall 128 and a closed end wall 130, and member 124 comprises a circular outer wall 132 and an inwardly extending peripheral flange 134 which provides for the corresponding end of the housing to be open. The drain cleaning apparatus further includes a drum 136 having a closed end wall 138 and a circular outer wall 140 spaced radially inwardly of the outer peripheral edge of wall 138 to define a peripheral flange 142 about the closed end of the drum. Drum 136 is received in the housing and supported for rotation relative thereto about axis A. More particularly, in this respect, end wall 138 of the drum is provided with an axially inwardly extending drum shaft 144, and end wall 130 of housing member 122 is provided with an axially inwardly extending hub 146 which receives the innermost end of shaft 144 and supports the latter for rotation about axis A. Drum 136 is axially retained in hub 146 by means of a washer 148 and a drum mounting fastener 150.

The axially inner side of end wall 138 of drum 136 is provided with a compartment 152 for receiving a motor unit M, a compartment 154 for receiving a battery pack 156, and an axially inwardly extending switch recess 158 having an inner wall 160 on which an on-off switch 162 is mounted. As in the previous embodiments, motor unit M includes an electric motor 164 connected to a gear box 166 having an output to a slip clutch coupling 60 by which inner end 42 of drain cleaning cable 40 is coupled to the motor unit. End wall 138 of the drum is provided with slots 139 for venting the motor unit compartment. The housing, as defined by housing members 122 and 124 has a cable opening 168, and cable 40 is coiled about drum 136 in the space between drum wall 140 and cylindrical walls 128 and 132 of the housing members, which space defines a cable passageway 38, and the cable extends outwardly through opening 168 and, as in the previous embodiments, has an outer end, now shown, which is adapted to be introduced into a drain to be cleaned. Preferably, opening 168 terminates in a collar 170 which is provided with barbs or the like to facilitate connecting a flexible guide tube thereto, such as that shown in connection with the embodiment of FIGS. 1-4. Opening 168 extends generally tangentially of the passageway at the upper portion of the housing. Motor unit M and battery pack 156 are axially captured in the corresponding compartment by a retainer 172 including a plate portion 174 overlying compartment 154 and a retaining arm 176 which depends therefrom and across compartment 152.

End wall 138 of drum 136 is provided on the axially outer side thereof with a crank arm 180 by which the drum can be manually rotated about axis A relative to the housing, and each of the housing members is provided with a pair of circumferentially spaced apart feet 182 for supporting the drain cleaner on an underlying surface in a use position as shown in the drawings. Further, closed end wall 130 of housing member 122 is provided with a plurality of radially extending axially outwardly projecting recesses 184 each of which terminates in a foot 186 which projects axially outwardly therefrom and which feet provide an alternative arrangement for supporting the drain cleaner on an underlying surface. Further, each of the housing members 122 and 124 is provided with a corresponding handle portion 188 which, when the housing members are assembled, provides a carrying handle diametrically opposite feet 182 of the housing.

As will be appreciated from the description of the previous embodiments herein, motor 164 is adapted to be energized through on-off switch 162, and when the latter is in the "on position" the motor operates through gear box 166 to rotate cable 40 about its axis and relative to the drum and housing components. If the cable extends through a flexible guide tube having a cable feeding device attached thereto as described in connection with the embodiment of FIGS. 1-4, the operator can actuate the feeding device to advance cable 40 outwardly of the housing and into a drain to be cleaned. In response to advancement of the cable in this respect, drum 136 is free to rotate in the clockwise direction in FIG. 11 to accommodate such cable displacement. When the operator actuates the cable feeding device to reverse the direction of cable displacement, drum 136 is free to rotate in the opposite direction as the cable is fed back into the housing. Advantageously in connection with this embodiment, the operator can actuate the switch to the "off position," thereby stopping rotation of the cable, and then manually rotate drum 136 through the use of crank arm 180 to more quickly draw the cable back into the housing.

In each of the foregoing embodiments, the housing components are constructed from a suitable plastic material such as polyethylene, for example, and preferably are constructed from an antibacterial plastic material or a plastic material such as polyethylene having an antibacterial additive therein such as the additive IRGAGUARD available from Ciba Specialty Chemicals, Inc. of Tarrytown, N.Y.

While considerable emphasis has been placed herein on preferred embodiments of the invention, it will be appreciated that other embodiments can be readily devised and that many changes can be made in the preferred embodiments without departing from the principals of the invention. In this respect, for example, it will be appreciated that a wide variety of on-off switch structures can be employed, that the use of a pneumatically actuated switch is optional, and that, if used, any variety of cable feeding devices can be employed either in association with a flexible guide tube or directly connected to or supported adjacent the housing. Further, it will be appreciated that the drive motor can be reversible in which case the main control switch would operate to reverse the direction of the output rotation of the motor, thus enabling the use of a cable feeding device with the drain cleaner which would operate to displace the cable into a drain in response to rotation of the cable in one direction about its axis and outwardly of the drain and into the housing in response to rotation of the cable in the opposite direction about its axis. These and other modifications of the preferred embodiments as well as other embodiments will be obvious to those skilled in the art upon reading the description herein, whereby the foregoing descriptive matter is to be interpreted merely as illustrative of the invention and not as a limitation.

Having thus described the invention, it is so claimed:

1. Drain cleaning apparatus comprising, a housing having a cable opening, a drain cleaning cable coiled in said housing about a coil axis and having a cable axis transverse to the coil axis and first and second ends, said second end extending outwardly through said cable opening, and a motor in the housing operatively connected to said first end of said cable for rotating said cable about said cable axis relative to the housing without rotating the housing.

2. Drain cleaning apparatus according to claim 1, wherein said motor for rotating said cable includes an electric motor connected to said first end of said cable.

3. Drain cleaning apparatus according to claim 2, further including a control switch on said housing for selectively connecting said motor to a source of electrical power.

4. Drain cleaning apparatus according to claim 3, further including a remotely operable switch for selectively disconnecting said motor from said source of electric power independent of said control switch.

5. Drain cleaning apparatus according to claim 1, wherein at least a portion of said housing is constructed of antibacterial plastic material.

6. Drain cleaning apparatus according to claim 1, wherein said cable is coiled in said housing about a coil axis transverse to said cable axis, and means for feeding the coiled cable outwardly and inwardly through said cable opening.

7. Drain cleaning apparatus according to claim 6, wherein said means for feeding includes a manually operated cable feed device.

8. Drain cleaning apparatus according to claim 7, further including a flexible guide tube having a first end adjacent the cable opening in said housing and having a second end spaced from the first end, and said feed device being coupled to said second end.

9. Drain cleaning apparatus according to claim 6, wherein said means for feeding includes means for rotating the coiled cable in opposite directions about said coil axis.

10. Drain cleaning apparatus comprising, a housing having a cable opening, a drain cleaning cable having a cable axis and first and second ends, said second end extending outwardly through said cable opening, means for feeding the coiled cable outwardly and inwardly through said cable opening in response to rotation of said cable and means for rotating said cable including said first end about said cable axis relative to the housing, wherein said cable is coiled in said housing about a coil axis transverse to said cable axis and wherein said housing includes an outer shell having a shell axis and an inner wall spaced inwardly therefrom, said cable opening being in said outer shell, and said cable being coiled about said inner wall.

11. Drain cleaning apparatus according to claim 10, wherein said means for rotating said cable includes a motor.

12. Drain cleaning apparatus according to claim 11, wherein said motor is in said housing and connected to said first end of said cable.

13. Drain cleaning apparatus according to claim 10, wherein the cable has a diameter and the space between the inner wall and outer shell is greater than said diameter and less than twice said diameter.

14. Drain cleaning apparatus according to claim 10, wherein said inner wall is rotatable relative to said outer shell about said shell axis.

15. Drain cleaning apparatus according to claim 14, and means including a crank for manually rotating said inner wall.

16. Drain cleaning apparatus according to claim 14, wherein said cable opening in said outer shell has an opening axis transverse to said shell axis.

17. Drain cleaning apparatus according to claim 16, wherein said opening axis is generally parallel to a line tangential to said outer shell.

18. Drain cleaning apparatus according to claim 17, wherein said shell axis is horizontal during use of the apparatus.

19. Drain cleaning apparatus according to claim 18, and means including a crank for manually rotating said inner wall.

20. Drain cleaning apparatus according to claim 10, wherein said inner wall is fixed against rotation relative to said outer shell.

21. Drain cleaning apparatus according to claim 20, wherein said cable opening in said outer shell has an opening axis parallel to said shell axis.

22. Drain cleaning apparatus according to claim 21, wherein said opening axis coincides with said shell axis.

23. Drain cleaning apparatus according to claim 22, wherein said shell axis is vertical during use of the apparatus.

24. Drain cleaning apparatus according to claim 23, wherein each said outer shell and inner wall have a generally vertical lower portion and a dome-shaped upper portion.

25. Drain cleaning apparatus according to claim 24, wherein said housing is constructed from antibacterial plastic material.

26. Drain cleaning apparatus comprising, a housing including an annular cable housing having radially spaced apart inner and outer walls providing a cable passageway therebetween having lower and upper ends, said outer wall having a cable opening therethrough, a drain cleaning cable having a cable axis and an inner end in said housing, said cable being coiled about said inner wall and extending outwardly through said cable opening, and a motor in said housing coupled to said inner end of the cable for rotating the cable, including the inner end thereof, about said cable axis relative to said housing without rotating said cable housing.

27. Drain cleaning apparatus according to claim 26, wherein said outer wall at said cable opening includes a coupling for attaching a flexible cable guide tube to said housing.

28. Drain cleaning apparatus according to claim 27, and a manually operable cable feed device coupled to said guide tube for displacing said cable inwardly and outwardly through said cable opening in response to rotation of said cable about said cable axis.

29. Drain cleaning apparatus according to claim 26, wherein said housing further includes a motor housing laterally adjacent said cable housing, said motor being in said motor housing.

30. Drain cleaning apparatus according to claim 29, and a handle between said motor housing and said cable housing.

31. Drain cleaning apparatus according to claim 30, wherein said housing and said handle are constructed from antibacterial plastic material.

32. Drain cleaning apparatus according to claim 29, wherein said motor is electrically operated and includes an output end coupled to said inner end of the cable.

33. Drain cleaning apparatus according to claim 32, wherein said output end of said motor has an axis generally tangential to said lower end of said passageway.

34. Drain cleaning apparatus according to claim 32, and a switch on said housing for selectively connecting said motor to a source of electrical power.

35. Drain cleaning apparatus according to claim 34, wherein said switch is on said motor housing, and a handle between said motor housing and said cable housing.

36. Drain cleaning apparatus according to claim 35, wherein said output end of said motor has an axis generally tangential to said lower end of said passageway.

37. Drain cleaning apparatus according to claim 36, wherein said outer wall at said cable opening includes a coupling for attaching a flexible cable guide tube to said cable housing, and a manually operable cable feed device coupled to said guide tube for displacing said cable inwardly and outwardly through said cable opening in response to rotation of said cable about said cable axis.

38. Drain cleaning apparatus, comprising a housing having a base and a cover, said base having a first base portion including an annular wall extending upwardly therefrom and a domed wall extending upwardly and radially inwardly from said annular wall, said base having a second base portion extending laterally of said first base portion, said cover having a first cover portion including an annular wall and domed wall respectively radially spaced from and overlying the annular wall and domed wall of said first base portion, said cover further including a second cover portion overlying said second base portion, an electric motor between the second portions of the base and cover, a drain cleaning cable having a cable axis, said cable being coiled about said annular wall of the first base portion and having an inner end coupled to said motor for said motor to rotate said cable about said cable axis relative to said housing, said domed wall of said first cover portion having a cable opening therethrough, and said cable extending outwardly through said opening and having an outer end spaced therefrom.

39. Drain cleaning apparatus according to claim 38, wherein said cable opening is through the apex of said domed wall of said first cover portion and includes a coupling for attaching a flexible cable guide tube thereto, and a manually operable cable feed device coupled to said guide tube for displacing said cable inwardly and outwardly through said cable opening in response to rotation of said cable about said cable axis.

40. Drain cleaning apparatus according to claim 38, and a manually operable control switch on said second cover portion for selectively connecting said motor to a source of power.

41. Drain cleaning apparatus according to claim 40, further including a remotely operable switch for selectively disconnecting said motor from said source of electric power independent of said control switch.

42. Drain cleaning apparatus according to claim 38, and a handle between the first and second cover portions.

43. Drain cleaning apparatus according to claim 42, wherein said handle has one end interconnected with said first cover portion and another end interconnected with said second cover portion.

44. Drain cleaning apparatus according to claim 43, wherein said first and second cover portions am separate from one another and removably mounted on said base.

45. Drain cleaning apparatus according to claim 44, wherein said one end of said handle is fastened to said first cover portion and said another end is slidably interengaged with said second cover portion.

46. Drain cleaning apparatus according to claim 42, wherein said housing and said handle are constructed from antibacterial plastic material.

47. Drain cleaning apparatus according to claim 42, and a manually operable control switch on said second cover portion for selectively connecting said motor to a source of power.

48. Drain cleaning apparatus according to claim 47, wherein said first and second cover portions are separate from one another and removably mounted on said base and said handle has one end interconnected with said first cover portion and another end interconnected with said second cover portion.

49. Drain cleaning apparatus according to claim 48, wherein said one end of said handle is fastened to said first cover portion and said another end is slidably interengaged with said second cover portion.

50. Drain cleaning apparatus according to claim 49, wherein said cable opening is through the apex of said domed wall of said first cover portion and includes a coupling for attaching a flexible cable guide tube thereto, and a manually operable cable feed device coupled to said guide tube for displacing said cable inwardly and outwardly through said cable opening in response to rotation of said cable about said cable axis.

51. Drain cleaning apparatus according to claim 50, further including a remotely operable switch for selectively disconnecting said motor from said source of electric power independent of said control switch.

52. Drain cleaning apparatus according to claim 38, wherein said housing is constructed from antibacterial plastic material.

53. Drain cleaning apparatus according to claim 38, wherein said motor rotates said cable about said cable axis without rotating said annular wall.

* * * * *